US006270149B1

(12) United States Patent
Fukumoto et al.

(10) Patent No.: US 6,270,149 B1
(45) Date of Patent: Aug. 7, 2001

(54) SLIDE DOOR APPARATUS FOR VEHICLES

(75) Inventors: Ryoichi Fukumoto, Nagoya; Katsuhisa Yamada, Toyota; Masao Ohhashi, Kariya; Shintaro Suzuki, Kasugai, all of (JP)

(73) Assignee: Aisin Seiki Kabushiki Kaisha Kariya, Aichi-Ken (JP)

( * ) Notice: Subject to any disclaimer, the term of this patent is extended or adjusted under 35 U.S.C. 154(b) by 0 days.

(21) Appl. No.: 09/449,670

(22) Filed: Nov. 30, 1999

(30) Foreign Application Priority Data

Dec. 14, 1998 (JP) ..... 10-355196

(51) Int. Cl.[7] ..... E05F 15/14
(52) U.S. Cl. ..... 296/155; 49/360; 303/6.1
(58) Field of Search ..... 296/155; 49/360, 49/138; 303/6.1

(56) References Cited

U.S. PATENT DOCUMENTS 4,984,385 * 1/1991 De Land ..... 49/360 X
5,140,316 * 8/1992 De Land et al. ..... 296/155 X
5,913,563 * 6/1999 Wantanabe et al. ..... 296/155
6,009,671 * 1/2000 Sasaki et al. ..... 49/352
6,087,794 * 7/2000 Kawanobe ..... 318/446
6,119,825 * 9/2000 Nisley ..... 188/171
6,125,583 * 10/2000 Murray et al. ..... 49/291

FOREIGN PATENT DOCUMENTS

0199722 * 10/1985 (JP) ..... 296/155
9-4323 1/1997 (JP) .
10-18708 1/1998 (JP) .
10-8828 1/1998 (JP) .

* cited by examiner

*Primary Examiner*—D. Glenn Dayoan
*Assistant Examiner*—Patricia Engle
(74) *Attorney, Agent, or Firm*—Burns, Doane, Swecker & Mathis, LLP

(57) ABSTRACT

A vehicular slide door apparatus includes a slide door which opens and closes an opening formed in a lateral side of a vehicle body. A brake device is provided at the lateral side of the vehicle body to apply a braking force to the slide door to adjust or control the speed of movement of the sliding door.

10 Claims, 9 Drawing Sheets

SLIDE DOOR APPARATUS FOR VEHICLES

This application is based on and claims priority under 35 U.S.C. § 119 with respect to Japanese Application No. 10(1998)-355196 filed on Dec. 14, 1998, the entire content of which is incorporated herein by reference.

FIELD OF THE INVENTION

The present invention generally relates to a vehicle door. More particularly, the present invention pertains to a slide door apparatus for vehicles.

BACKGROUND OF THE INVENTION

Known types of slide door apparatus are disclosed in Japanese Patent Laid-Open Publication Nos. Hei. 9-4323, Hei. 10-8828, and Hei. 10-18708.

In each of these apparatus, when an electrically operated driving mechanism is turned on, the resultant rotation in one direction moves the slide door in its opening direction, thereby opening the opening area formed in the side of the vehicle body. The resulting rotation in the other direction moves the slide door in its closing direction, thereby closing the opening area formed in the side of the vehicle body.

A clutch mechanism is interposed between the driving mechanism and the slide door. If the clutch mechanism is in its disengaged condition, the slide door is isolated from the driving mechanism, thereby allowing the slide door to be moved manually. However, when the vehicle is parked on a sloping road, the gravity applied to the inclined slide door causes the door to be opened unexpectedly and excessively fast.

Accordingly, a need exists for a slide door apparatus for vehicles in which the sliding speed of the slide door is controllable or adjustable.

SUMMARY OF THE INVENTION

In light of the foregoing, the present invention provides a vehicular slide door apparatus that includes a plurality of guide rails mounted on a lateral side of a vehicle body, a slide door mounted on the guide rails for sliding movement in a lengthwise direction of the vehicle body between a fully open position and a fully closed position, an elongated member connected to the slide door, and a brake device operatively associated with the elongated member for applying a brake force to the elongated member during sliding movement of the slide door from the fully open position towards the fully closed position to control movement of the slide door during movement from the fully open position towards the fully closed position.

According to another aspect of the invention, a vehicular slide door apparatus includes a slide door movable along a lengthwise direction of the vehicle body for opening and closing an opening area formed in a lateral side of the vehicle body, and a brake device provided at the lateral side of the vehicle body for applying a brake force to the slide door.

BRIEF DESCRIPTION OF THE DRAWING FIGURES

The foregoing and additional features of the present invention will become more apparent from the following detailed description considered with reference to the accompanying drawing FIGS. in which like elements are designated by like reference numerals and wherein.

DETAILED DESCRIPTION OF THE INVENTION

Figure 1:
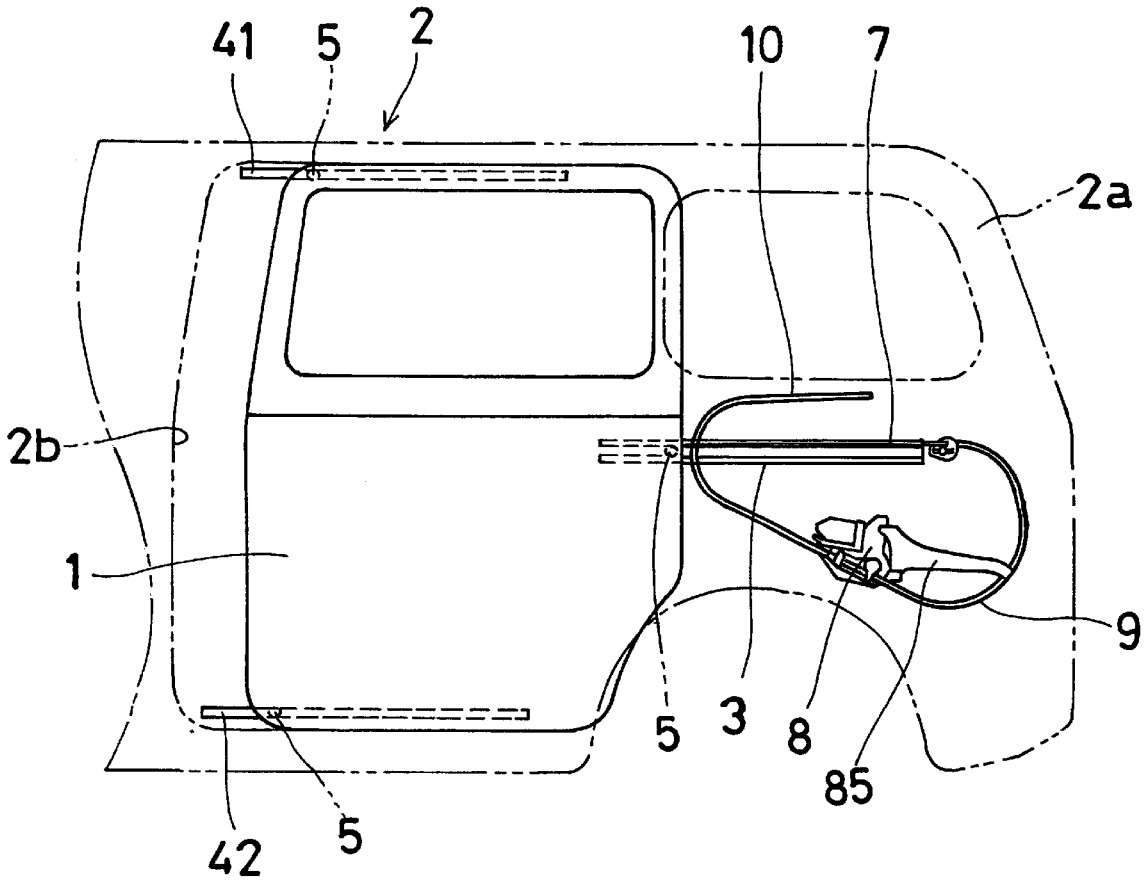
FIG. 1 is a side view of a vehicle body at which is positioned a slide door apparatus according to the present invention.
Figure 2:
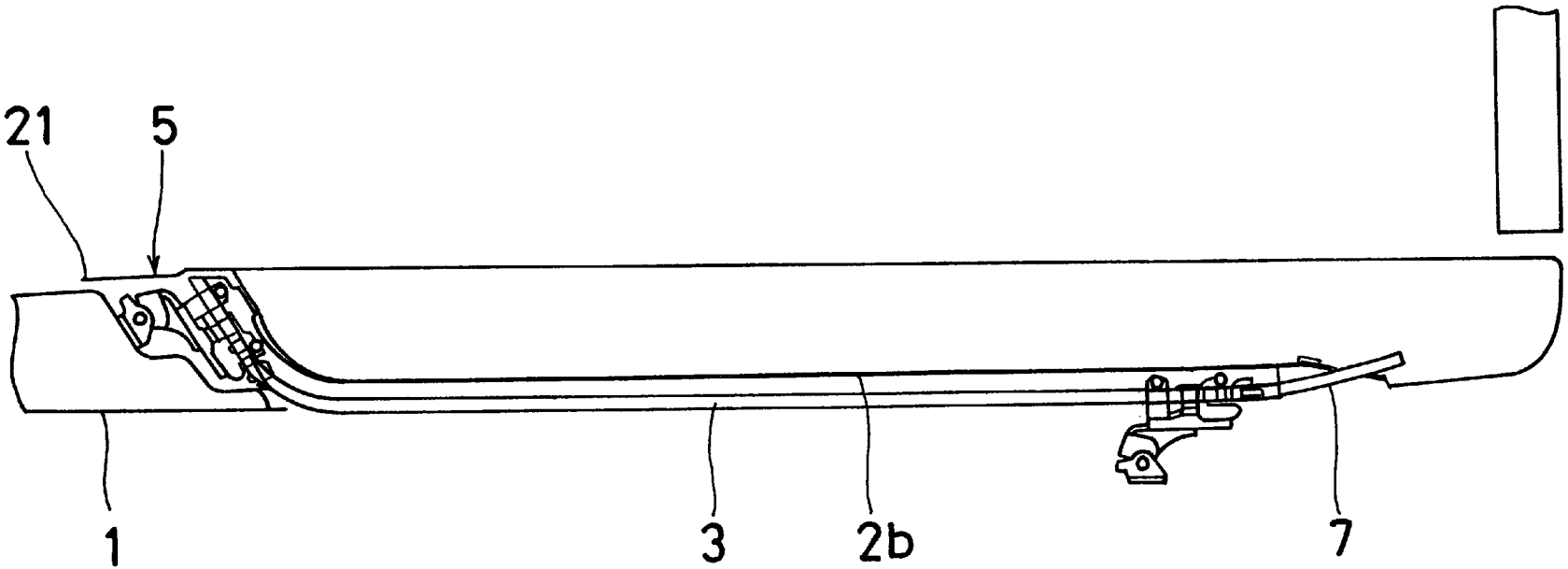
FIG. 2 is a horizontal cross-sectional view of the slide door apparatus shown in FIG. 1.

FIGS. 1 and 2 illustrate the rear portion of the vehicle body 2 of a van type vehicle. The lateral side 2*a* of the vehicle body 2 is provided with an opening area 2*b* possessing a substantially rectangular shape. The opening area 2*b* is adapted to be closed and opened by a slide door 1. The slide door 1 is supported by an upper guide rail 41, a lower guide rail 42 and a center guide rail 3 so as to be movable in the vehicle lengthwise direction corresponding to the right-and-left direction in FIG. 1.

The upper guide rail 41 is arranged along the upper periphery of the opening area 2*b* at a position closely adjacent the opening area 2*b* and is secured to the lateral side 2*a* of the vehicle body 2 by way of suitable connecting devices such as screws. The lower guide rail 42 is arranged along the lower periphery of the opening area 2*b* at a position closely adjacent the opening area 2*b* and is secured to the lateral side 2*a* of the vehicle body 2 by way of suitable connecting devices such as screws. The center guide rail 3 is positioned at the rear side of the opening area 2*b* and is secured to the lateral side 2*a* of the vehicle body 2 by way of suitable connecting devices such as screws.

The slide door 1 is provided with three guide roller units 5 which slidably engage the respective guide rails 3, 41, 42, thereby allowing the slide door 1 to slide along the guide rails 3, 41, 42. The guide rails 3, 41, 42 are arranged parallel to each other and extend in the vehicle lengthwise direction. For establishing a coplanar relationship between the outer surface of the slide door and the outer surface of the lateral side 2*a* of the vehicle body 2 when the opening area 2*b* is fully closed by the slide door 1 (i.e., when the slide door 1 is in the fully closed position), the front end of each of the guide rails 3, 41, 42 is bent toward the interior or inner space of the vehicle body 2. When the opening area 2*b* is fully opened (i.e., when the slide door 1 is in the fully opened position), the slide door 1 is positioned at the rear side of the opening area 2*b* and is positioned in an overlapping condition relative to the lateral side 2*a* of the vehicle body 2.

Figure 3:
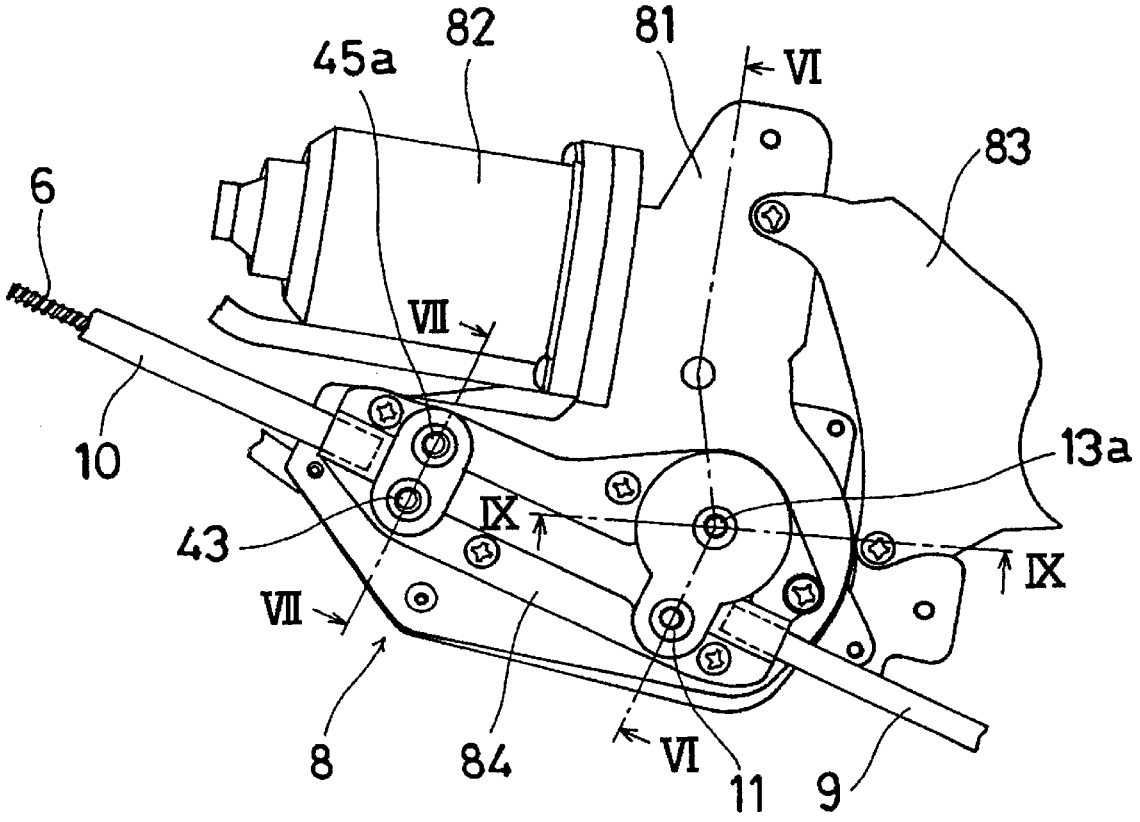
FIG. 3 is a front view of the driving device associated with the slide door apparatus shown in FIG. 1.

The roller unit 5 which slides along the center guide rail 3 is connected to one end of a geared cable 6, seen in FIG. 3, which passes through several guide pipes 7, 9, 10. The geared cable 6 thus forms an elongated member which moves together with the slide door 1. The other end of the geared cable 6 forms a free end of the cable. The geared cable 6 is connected to a drive device 8, the details of which will be described below, at a position between the guide pipes 7, 9. The guide pipe 7 extends along the center guide rail 3 and is secured to the center guide rail 3. The guide pipe 9 is fixed to the inside of the vehicle body 2, with one end of the guide pipe 9 passing therethrough for being connected to the guide pipe 7 at the rear portion of the guide rail 3. The other end of the guide pipe 9 is connected to the drive device 8. The guide pipe 10 is fixed inside the vehicle body 2 and is connected to the drive device 8.

When the drive device 8 is turned on, the geared cable 6 is moved in one direction, which causes movement of the center positioned roller unit 5 along the center guide rail 3. As a result, the slide door 1 moves along the guide rails 3, 41, 42 , thereby opening the opening area 2*b* in the lateral side 2*a* of the vehicle body. When the drive device 8 is operated in the opposite direction, the geared cable 6 is moved in the opposite direction, and this causes movement of the center positioned roller unit 5 along the center guide rail 3 in the opposite direction. The slide door 1 is thus moved along the guide rails 3, 41, 42, thereby closing the opening area 2*b* in the lateral side 2*a* of the vehicle body.

Referring to FIGS. 3–7, the drive device 8 includes a casing 81 and an electric motor 82 functioning as an electrically operated driving source. The casing 81 is fixedly mounted on a bracket 83 which is secured to the lateral side 2*a* of the vehicle body 2. The motor 82 is fastened to the casing 81. The casing 81 includes a first housing part 81*a* and a second housing part 81*b* which are coupled or connected with each other by way of bolts 81*c*. An inner space D is defined within the housing that results from connection of the two housing parts 81*a*, 81*b*. The housing part 81a of the casing 81 is connected with a cover 84 by a bolt 84*a*, thereby defining an accommodating space E between the housing part 81*a* and the cover 84.

A shaft 11 is journalled in the casing 81. The shaft 11 passes through the housing part 81*a*, the inner space D, and the accommodating space E. One end portion 11*a* of the shaft 11 is journalled in the cover 84 via a bush 84*b*, while the other end portion 11*b* of the shaft 11 is journaled in the housing part 81*b* via a bush 81*d*. A portion 11*c* of the shaft 11 is also journalled in the housing part 81*a* via a bush 81*e*. Between the end portions 11*a*, 11*c*, the shaft 11 is provided with a portion 11*e* in the form of a serration which is positioned in the accommodating space E. Between the portions 11*a*, 11*b*, the shaft 11 is provided with a supporting portion 1 If and a serrated portion 11*g*.

An output gear 12 is mounted on the serrated portion 11*e* of the shaft 11 so that the output gear 12 and the serrated portion 11*e* of the shaft I1 are rotated together. In the accommodating space E, a driven gear 13 is rotatably supported on the housing 81*a* and the cover 84 via a pin 31*a*, and is positioned in opposition to the output gear 12. The geared cable 6 which is accommodated in the accommodating space E is in meshing engagement with both the output gear 12 and the driven gear 13.

A rotor 14 formed of a magnetic material is mounted on the serrated portion 11*g* of the shaft 11 so that the rotor 14 rotates together with the serrated portion 11*g* of the shaft 11. The upper and lower surfaces of the rotor 14 are provided with respective annular grooves 14*b*, 14*c* which communicate with each other by a plurality of circumferentially arranged arc-shaped slots 14*a* having a common center point. An annular geared projection 14*d* is formed on the upper surface of the rotor 14 and is positioned outside the groove 14*c*.

Figure 5:
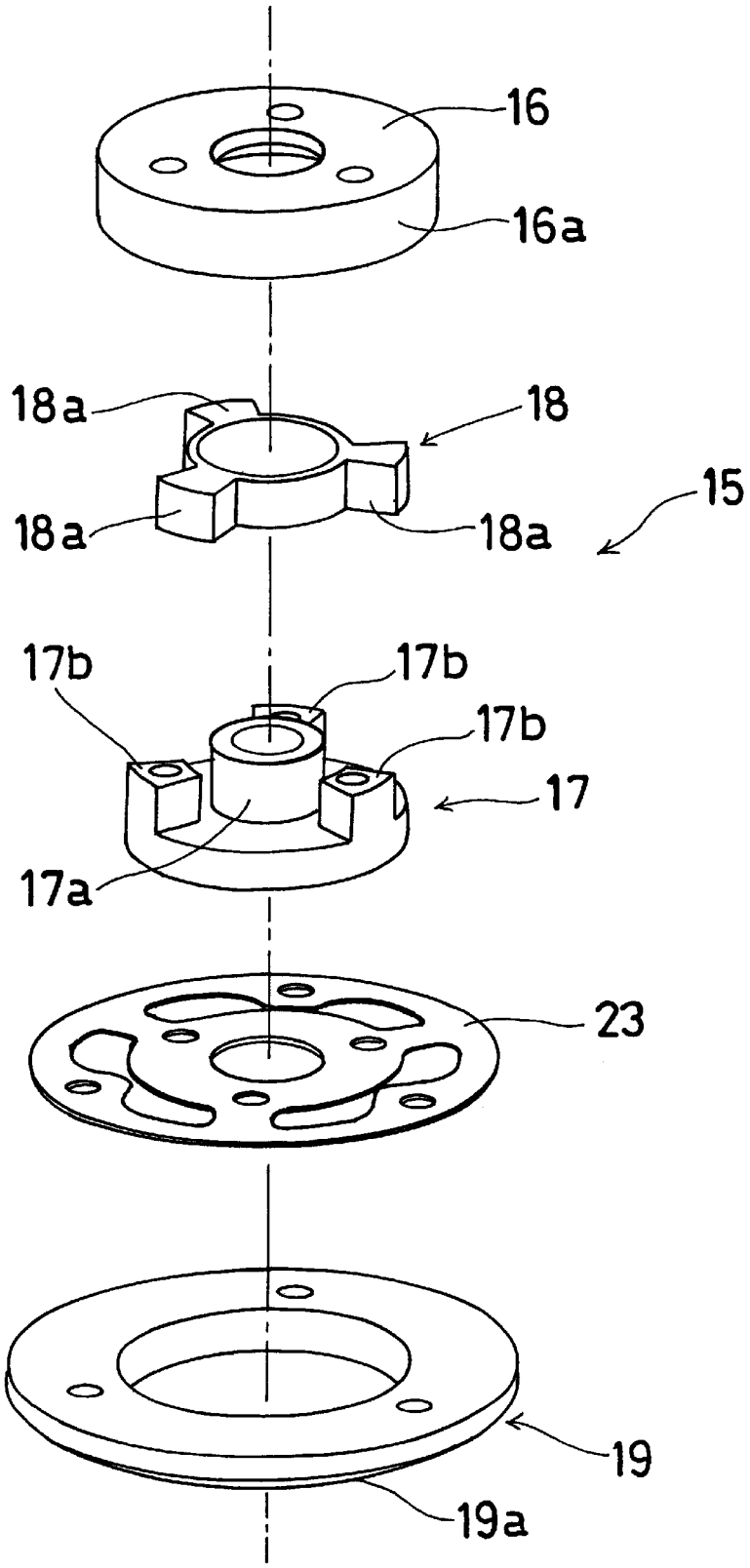
FIG. 5 is an exploded perspective view of the second disk assembly employed in the driving device shown in FIG.3.
Figure 6:
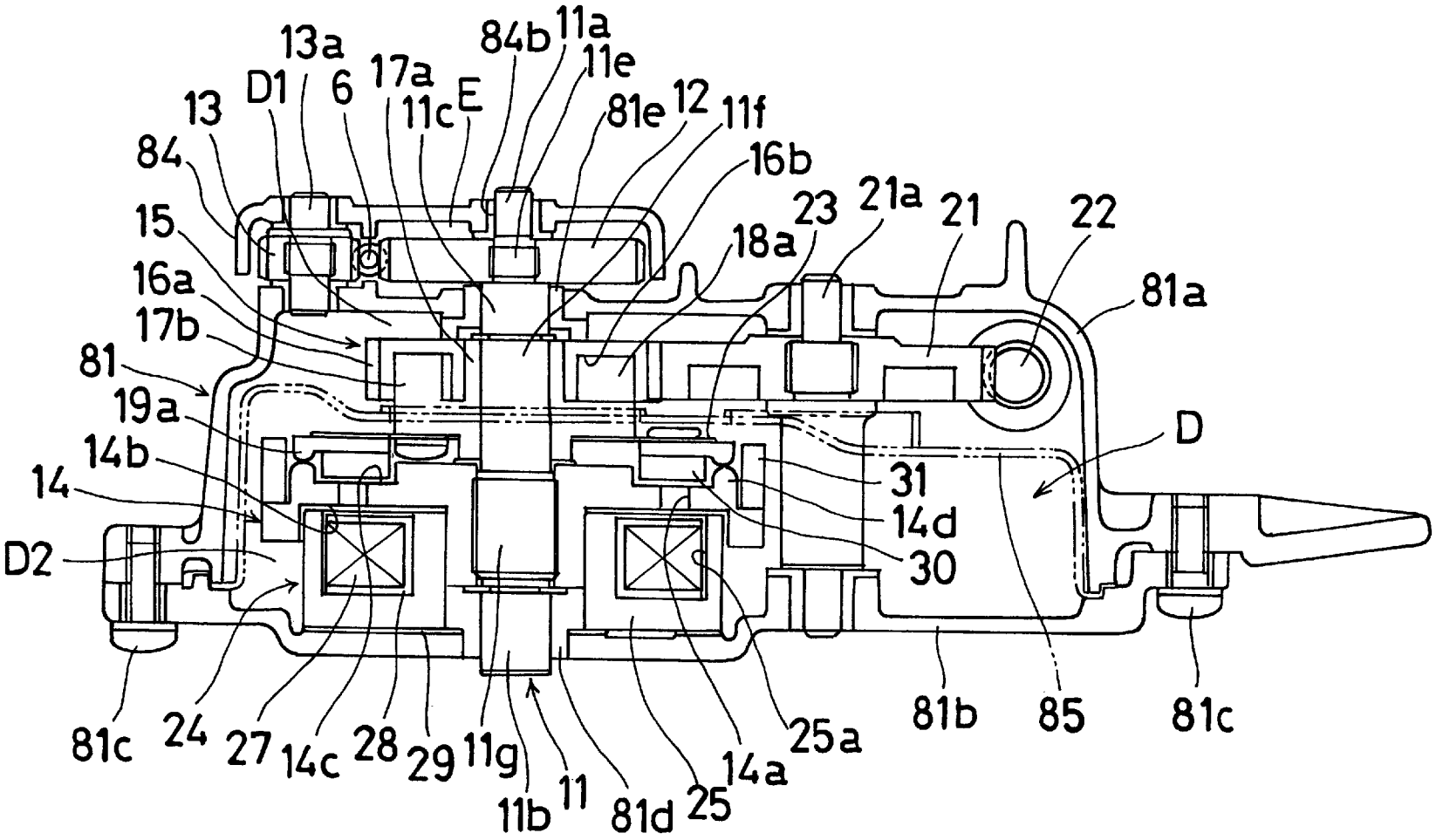
FIG. 6 is a cross-sectional view taken along the section line VI—VI in FIG.4.
Figure 7:
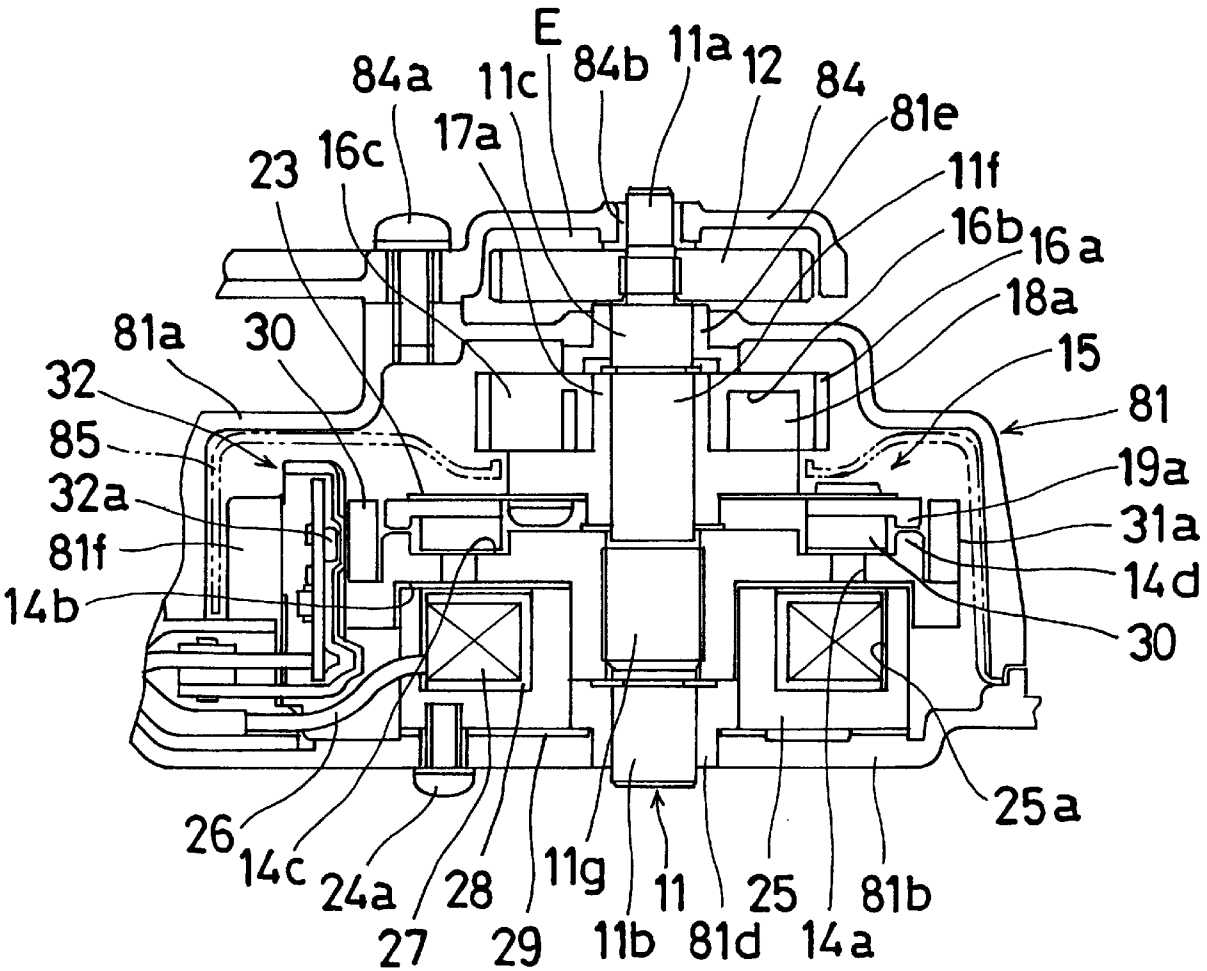
FIG. 7 is a cross-sectional view taken along the section line VII—VII in FIG.4.

A disk assembly 15 is mounted on the supporting portion 11*f* of the shaft 11 so as to rotate relative to the supporting portion 11*f*. As best shown in FIG. 5, the disk assembly 15 includes an input wheel 16, an output wheel 17, a movable plate 19, and an elastic member 18 formed of, for example, rubber. The output wheel 17 is rotatably mounted on the supporting portion 11*f* of the shaft 11.

The input wheel 16 is rotatably mounted on a boss portion 17*a* of the output wheel 17. The outer periphery of the input wheel 16 possesses a geared configuration 16*a* which is adapted to be in indirect meshing engagement with a worm gear 22 via an idle gear 21. The idle gear 21 is positioned in the inner space D of the casing 81 and is rotatably supported on the two housing parts 81*a*, 81*b* via a pin 21*a*. The worm gear 22 which is in meshing engagement with the idle gear 21 is fixedly mounted on the output shaft of the motor 82 which extends into the inner space D of the casing 81. The idle gear 21 and the worm gear 22 constitute a speed reduction gear train.

The input wheel 16 is provided in its lower surface with an annular groove 16*b* into which a plurality of projections 16*c* extend. The output wheel 17 is provided with equi-pitched projections 17*b* each of which, when fitted in the annular groove 16*b* in the input wheel 16, is in opposition to two adjacent projections 16*c*, 16*c*. An elastic member 18 which is accommodated in the annular groove 16*b* of the input wheel 16 has equi-pitched damper portions 18*a* each of which is positioned between two adjacent projections 16*c*, 17*b*.

The movable plate 19 is in the form of a circular plate. The upper surface of the movable plate 19 is secured to a ring-shaped leaf spring 23 by way of screws which is riveted to the output wheel 17, thus allowing the movable plate 19 to rotate together with the output wheel 18. The movable plate 19 is capable of being deformed in its axial direction, which enables the movable plate 19 to move in the axial direction. The movable plate 19 is provided at its lower surface with a ring-shaped or annular geared portion 19*a*.

When the electric motor 82 is turned on, the resulting rotational torque is transmitted, by way of the speed-reduction gear train, to the input wheel 16. The rotation of the input wheel 16 is transmitted from the projections 16a of the input wheel 16 to the projections 17*b* of the output wheel 17 via the damper portions 18*a* of the elastic member 18, thereby rotating the output wheel 17. The damper portions 18*a* of the elastic member 18 absorb shocks to some extent which inevitably occur between the input wheel 16 and the output wheel 17.

The rotation of the output wheel 17 is transmitted by way of the leaf spring 23 to the movable plate 19. This causes rotation of the movable plate 19, thereby rotating the rotor 14 which is in meshing engagement with the movable plate 19 by engagement of the geared portion 19*a* of the movable plate 19 with the geared projection 14*d* on the rotor 14.

A ring-shaped or annular electromagnetic coil winding device 24 is accommodated within the inner space D of the casing 81 so that the electromagnetic coil winding device 24 is positioned around the shaft 11. The coil winding device 24 includes a core 25 and a coil winding 27. The core 25 is formed of a magnetic material and has an upper open-faced annular groove 25*a*. The coil winding 27 is supplied with electric current from an external power supply by way of a pair of harnesses 26. The coil winding 27 is formed on a bobbin 28 in winding mode and is acconmmodated in the annular groove 25*a*. The electromagnetic coil winding device 24 is positioned in the annular groove 14*b* of the rotor 14 and is secured to the housing 81*b* of the casing 81 by a plurality of bolts 24*a*. An anti-vibration plate 29 made of a rubber or a resin material is held between the housing 81*b* and the coil winding device 24.

A ring-shaped or annular armature 30 which is formed of electromagnetic material is fixedly mounted on the lower surface of the movable plate 19. The armature 30 is positioned in the annular groove 14*c* of the rotor 14 and is located in opposition to the electromagnetic coil winding device 24 with the rotor 14 being located between the armature 30 and the electromagnetic coil winding device 24. Positioning the electromagnetic coil winding device 24 and the armature 30 in the respective annular grooves 14*b*, 14*c* of the rotor 14 reduces the axial extent or thickness of the driving device 8, thereby establishing a thinner driving device 8.

The movable plate 19 of the disk assembly 15, the rotor 14, and the electromagnetic coil winding device 24 together constitute a clutch mechanism CL.

When the coil winding 27 of the electromagnetic coil winding device 24 is energized, a magnetite closed loop is produced which circulates through the coil winding 27, the core 25, the rotor 14, and the armature 30. This generates an electromagnetic force attracting the armature 30 toward the rotor 14. Then, the movable plate 19 is brought into axial movement toward the rotor 14 in such a manner that the movable plate 19 is increasingly deformed, which causes a meshing engagement between the geared portion 19*a* of the movable plate 19 and the geared portion 14*a* of the rotor 14. Thus, the clutch mechanism CL assumes its ON-condition which allows the rotor 14 to rotate together with the disk assembly 15. The anti-shock plate 29 decreases the shock sound which inevitably occurs upon meshing engagement between the geared portion 19*a* of the movable plate 19 and the geared portion 14*a* of the rotor 14, thereby reducing the resonance sound at the lateral side 2*a* of the vehicle body 2. Thus, the sound which occurs during the operation of the driving device 8 becomes reduced to a significant extent.

When current application to the coil winding 27 of the electromagnetic coil winding device 27 is interrupted, the foregoing attraction force disappears or stops. The restoration force of the leaf spring 23 thus causes the reverse axial movement of the movable plate 19, thereby releasing the geared portion 19*a* of the movable plate 19 from the geared portion 14*d* of the rotor 14. The clutch mechanism CL thus assumes the OFF-condition under which the disk assembly 15 is able to rotate relative to the rotor 14.

An annular magnet 31 is fixedly positioned in the annular groove 14*c* of the rotor 14. The magnet 31 is positioned outside the magnetite closed loop which circulates through the core 25, the rotor 14, and the armature 30. Thus, the magnet 31 is not affected even when the coil winding 27 is being applied with current. Plural sets of N-pole and S-pole combinations are magnetized alternately along the entire outer periphery 31*a* of the magnet 31 in such a manner that the Npoles and S-poles are arranged alternately.

A door sensor 32 is provided in the casing 81 and is positioned in opposing relation to the magnet 31. The sensor 32 includes a pair of Hall elements 32*a*, 32*a* both of which are secured to a vertical wall 81*f* of the housing 81*b* by screws. While the magnet 31 is being rotated, the Hall elements 32*a*, 32*a* issue signals, respectively, which are of a phase difference of 90 degrees. This means that the sensor 32 serves for detecting the rotational condition of the rotor 14. Such signals are fed to a CPU 141 of an electronic control device 100 as will be described later and are used to calculate the sliding speed of the slide door 1, the sliding direction of the slide door 1, and the current position of the slide door 1.

A divider 85 is positioned in the casing 81 such that the outer periphery of the divider 85 is held between the housing parts 81*a*, 81*b*. The shaft 11 passes through the divider 85. The divider 85 divides the inner space D of the casing 81 into a first inner sub-space D1 and a second inner sub-space D2. The input wheel 16 of the disk assembly 15 and the speed reduction gear train are accommodated in the first inner sub-space D1, while the output wheel 17 of the disk assembly 15, the movable plate 19, the rotor 14, the electromagnetic coil winding device 24, and the sensor 32 are accommodated in the second inner sub-space D2. Due to this arrangement, the rotor 14, the movable plate 19, and the sensor 32 are not liable to be infiltrated with grease between the idle gear 21 and the input wheel 16 or with metal powder generated by the meshing engagement.

The following is a description of the operation of the driving device 8 in conjunction with slide movement of the slide door 1. To slide the slide door 1, the clutch mechanism CL is first brought into the ON-condition under which the rotor 14 is rotatable together with the disk assembly 15 due to the fact that the geared portion 14*d* of the rotor 14 is in meshing engagement with the geared portion 19*a* of the movable plate 19 while the coil winding 27 of the coil winding device 24 is being energized. Under such a condition, if the electric motor 82 is turned on, the resulting rotation, after passing through the speed reduction gear train, rotates the disk assembly 15 and the rotor 14, which causes rotation of the shaft 11, thereby rotating the output gear 12. Thus, the geared cable 6 which is in meshing engagement with the output gear 12 is moved in one direction to open the slide door 1 or in the opposite direction to close the slide door 1. Establishing concurrent rotation of the rotor 14 and the disk assembly 15 causes an electrical operation of the slide door 1 under which the slide door 1 is moved by the electric motor 82. Immediately upon the slide door 1 being brought into its fully opened condition or closed condition, the current application to the coil winding 27 of the electromagnetic coil winding device 24 and the electric motor 82 is turned off.

When the clutch mechanism CL is in the OFF-condition, the rotor 14 is rotatable relative to the disk assembly 15 due to the fact that the geared portion 14*d* of the rotor 14 is out of meshing engagement with the geared portion 19*a* of the movable plate 19 and the coil winding 27 of the coil winding device 24 is not being energized. Under such a condition, manual operation of the slide door 1 is established. That is, if the slide door 1 is moved manually in one direction to open the slide door or is moved in the opposite direction to close the slide door, the resulting movement of the geared cable 6 rotates the shaft 11 due to the fact that the geared cable 6 is in meshing engagement with the output gear 12, The rotor 14 is thus rotated. At this time, the geared portion 14*d* of the rotor 14 is out of meshing engagement with the geared portion 19*a* of the movable plate 19 and so rotation of the rotor 14 is not transmitted to the disk assembly 15.

Figure 4:
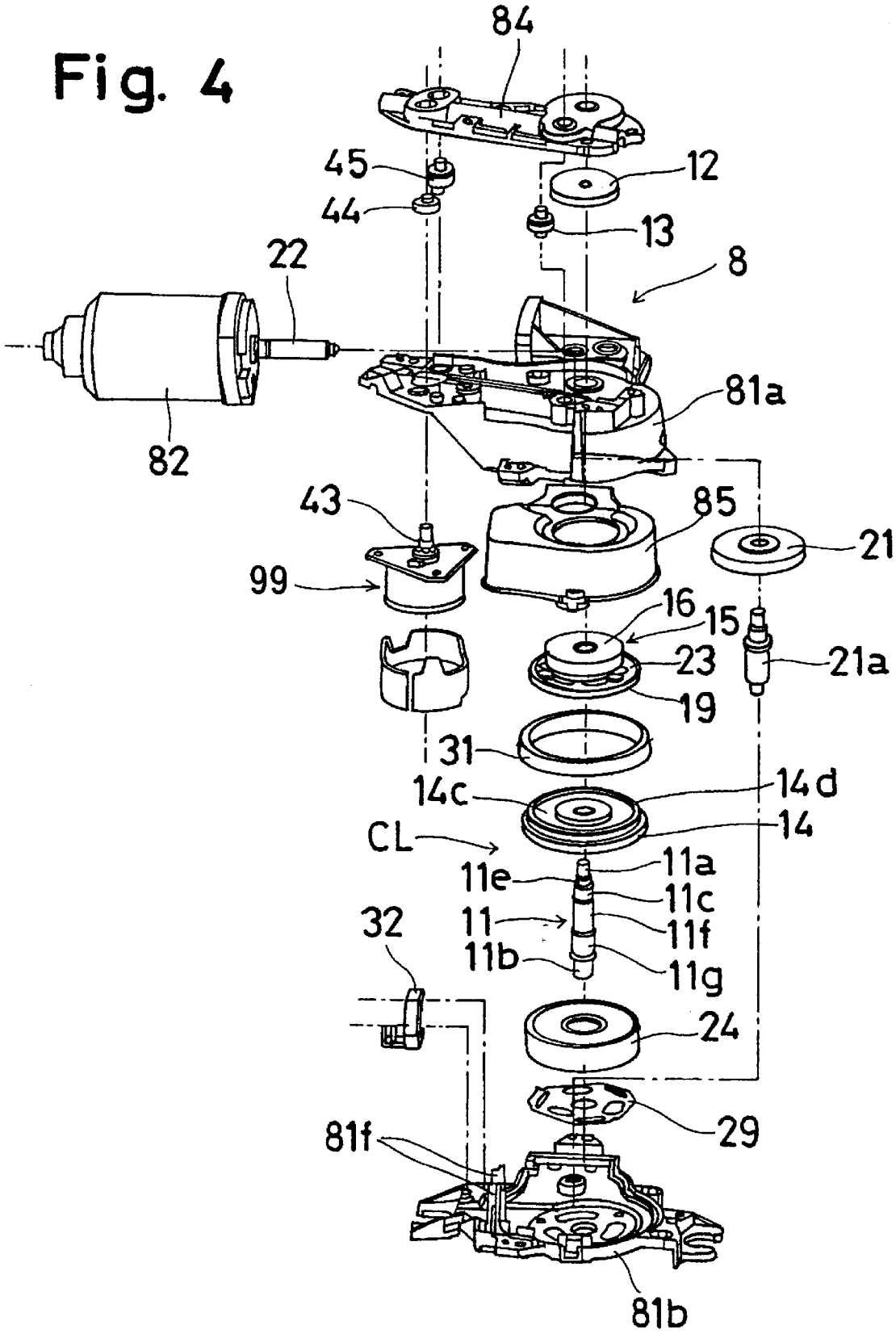
FIG. 4 is an exploded perspective view of the driving device shown In FIG.3.

As can be understood from the illustration in FIG. 4, the clutch mechanism CL is provided with a brake device 99. As described below in more detail, this brake device in affect applies a braking force to the slide door to control sliding movement of the slide door.

Figure 8:
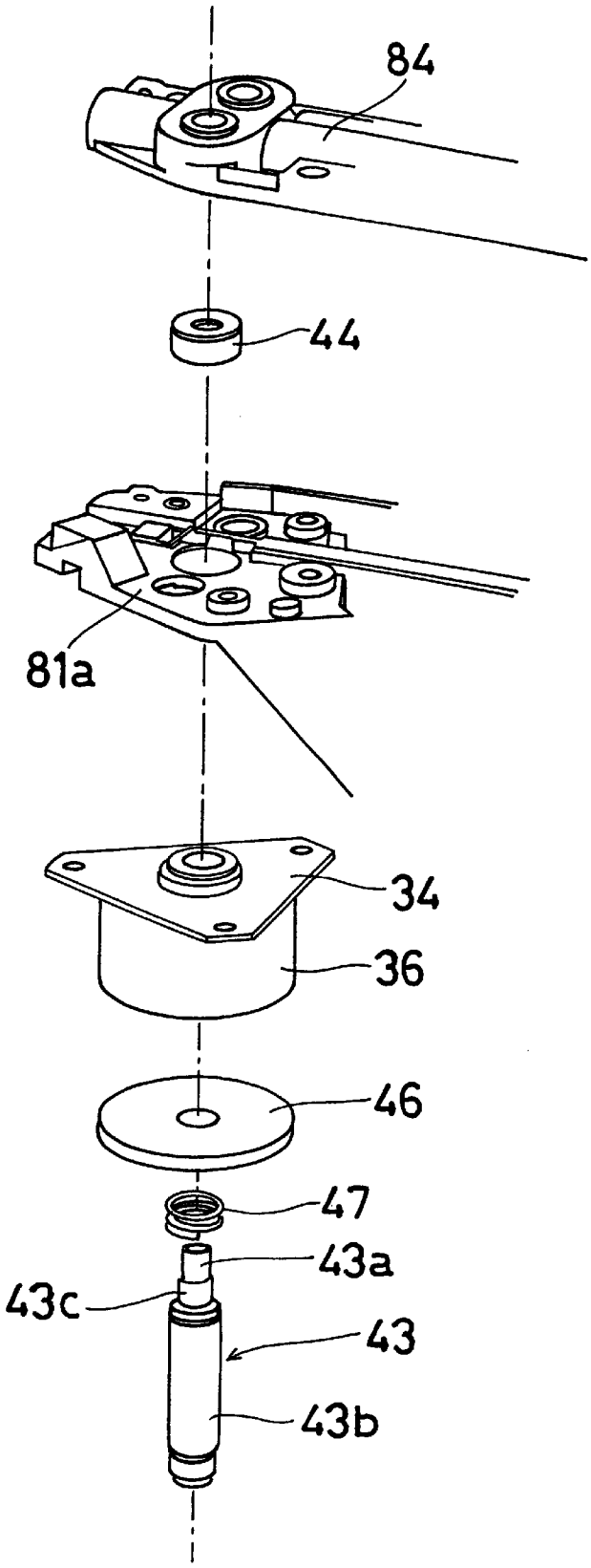
FIG. 8 is an exploded perspective view of a brake device used in conjunction with the driving device shown in FIG. 3.
Figure 9:
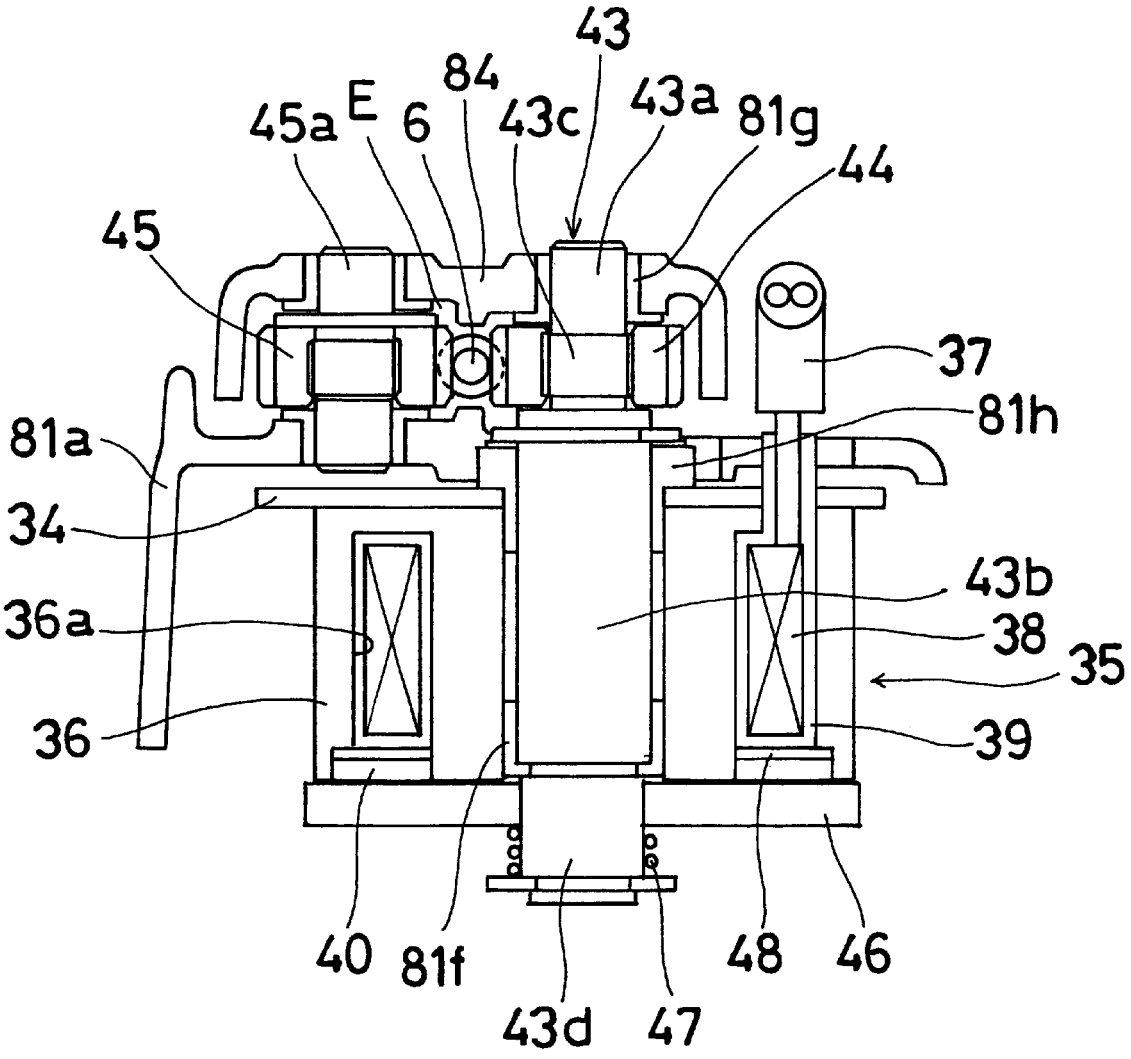
FIG. 9 is a cross-sectional view taken along the section line IX—IX in FIG.4.

Referring to FIGS. 8 and 9, a bracket 34 is secured by bolts to the housing part 81*a* of the casing 81. The bracket 34 is fixed with an electromagnetic coil winding device 35. The coil winding device 35 includes a core 36 and a coil winding 38. The core 36 is formed of a magnetic material and has a lower openfaced annular groove 36*a*. The coil winding 38 is applied with electric current from an external power supply by way of harness wires 37. The coil winding 38 is mounted on a bobbin 39 and is accommodated in the annular groove 36*a*. The opening of the annular groove 36*a* is closed by an annular metal plate 48 and a friction plate 40 in such a manner that the friction plate 40 projects slightly beyond the bottom of the core 36.

A shaft 43 is journalled in the electromagnetic coil winding device 35 via a pair of axially spaced bushes 81*g*, 81*f*. The shaft 43 is so positioned as to traverse the accommodating space E after passing through the bracket 34 and the housing 81*a*. One end side portion 43*a* of the shaft 43 is journalled in the cover 84 via a bush 81*g*, and an intermediate portion 43*b* of the shaft 43 around which the coil winding device 35 is positioned is journalled in both the bracket 34 and the housing 81*a* via a bush 81*h*. The shaft 43 is provided with a serration portion 43*c* between the end portion 43*a* and the intermediate portion 43*b*, and is located within the accommodating space E. The other end portion of the shaft 43 defines another serration portion 43*d* located adjacent or next to the intermediate portion 43*b*.

A brake gear 44 is mounted on the serration portion 43*c* of the shaft 43 and is thus rotated together with the serration portion 43*c*. A driven gear 45 is positioned in the accommodating space E. The driven gear 45 is fixedly mounted on a pin 45*a* whose opposite end portions are journalled in the housing 81 and the cover 84 respectively. The driven gear 45 is positioned in opposition to the brake gear 44. The brake gear 44 is in indirect meshing engagement with the driven gear 45 via the geared cable 6 which extends through the accommodating space E.

An armature 46 is mounted on the serration portion 43*d* of the shaft 43 so that the armature is movable along the serration portion 43*d* of the shaft 43 and is rotatable together with the serration portion 43*d* of the shaft 43. The armature 46 is formed of a magnetic material and is configured as a circular plate.

The armature 46 is urged continually by a spring 47 that is arranged around the shaft 43 so that the armature 46 is in slight face-to-face contact with the friction plate 40.

When the coil winding 38 of the coil winding device 35 is energized, a magnetic closed loop is formed which passes through the coil winding 38, the core 36 and the armature 46, thereby generating an electromagnetic force which attracts the armature toward the rotor 36. Thus, the armature 46 moves along the shaft 43 toward the core 36 so that the armature 46 is strongly brought into engagement with the friction force 40, thereby imparting a large friction force acting as a brake force to the armature 46 under rotation. When the coil winding 38 of the coil winding device 35 is de-energized, there is no magnetic attraction force which attracts the armature toward the core 36, thus allowing the armature 46 to rotate freely relative to the friction plate 40. The reason is that between the friction plate 40 and the armature 46 under rotation, there is a very small amount of friction force which is unable or insufficient to brake the friction plate 40.

The operation of the brake device 99 in conjunction with the movement of the slide door 1 is as follows. While the slide door 1 is moving, the geared cable 6 is also moving in one direction (or the other direction), and the meshing engagement between the geared cable 6 and the brake gear 44 causes the brake gear 44, the shaft 43, and the armature 46 to rotate.

When the slide door 1 is moving by virtue of either the driving operation of the driving device 8, manual operation, or gravity unexpectedly applied to the slide door 1 when the vehicle is parked on a slanted or sloping road, the CPU 141 calculates the sliding speed of the slide door 1 on the basis of the signals issued from the sensor 32. If the detected sliding speed of the slide door 1 exceeds a predetermined value, the coil winding 38 of the coil winding device 35 is energized, and an immediate and strong engagement of the armature 46 with the friction plate 40 occurs, thereby generating a very large friction force between the armature 46 and the friction plate 40. Thus, with little time lag, a braking force is applied to the slide door 1.

The foregoing operation of the brake device 99 is under the control of the CPU 141. The control device 100 allows the operator to move the slide door 1 in a smooth manner when the slide door 1 is moved in the manual mode.

In addition, in the case where no driving device 8 is provided to the vehicle 1, the brake device 99 can be applied thereto. That is to say, solely the use of the brake device 99 can be employed. In this structure, the magnet 31 is positioned on the armature 46 and the sensor 32 positioned in opposing relation thereto detects the rotational condition of the armature 46 for determining the sliding speed, the sliding direction, and the current position of the slide door 1.

In accordance with the present invention, the vehicular slide door apparatus includes a brake device provided at the lateral side of the vehicle body for applying a brake force to the slide door. Thus, the sliding speed of the slide door can be adjusted or controlled. If the vehicle is parked on a slanted or sloping road, the slide door is prevented from moving at a high speed. If the slide door begins to slide unexpectedly, the movement of the slide door is stopped or slowed, thus ensuring safe operation of the slide door. In addition, controlling the brake device in a suitable manner ensures that safe and smooth manual operations of the slide door are compatible.

Moreover, controlling the brake device in a suitable manner also ensures the switching operation of the clutch mechanism. In situations where the slide door is in an automatic operation mode, the slide door can be prevented from being moved when the window of the slide door is in the opened condition.

The principles, preferred embodiment and modes of operation of the present invention have been described in the foregoing specification. However, the invention which is intended to be protected is not to be construed as limited to the particular embodiment described. Further, the embodiment described herein is to be regarded as illustrative rather than restrictive. Variations and changes may be made by others, and equivalents employed, without departing from the spirit of the present invention. Accordingly, it is expressly intended that all such variations, changes and equivalents which fall within the spirit and scope of the invention be embraced thereby.

What is claimed is:

1. A vehicular slide door apparatus comprising:

a plurality of guide rails mounted on a lateral side of a vehicle body;

a slide door mounted on the guide rails for sliding movement in a lengthwise direction of the vehicle body between a fully open position and a fully closed position;

cable connected to the slide door;

a brake device operatively associated with the cable for applying a brake force to the cable during sliding movement of the slide door from the fully open position towards the fully closed position to control movement of the slide door during movement from the fully open position towards the fully closed position, the brake device including a shaft, an armature mounted on the shaft to rotate together with the shaft, an electromagnetic coil winding device opposing the armature, and a friction plate secured to the electromagnetic coil winding device and engageable with the armature; and a brake gear mounted on the shaft for rotating together with the shaft, said brake gear engaging the cable.

2. The vehicular slide door apparatus as set forth in claim 1, including a drive device operatively associated with the cable, and a clutch mechanism for alternatively establishing and interrupting a coupling between the slide door and the drive device.

3. The vehicular slide door apparatus as set forth in claim 2, wherein the brake device is mounted on the drive device.

4. The vehicular slide door apparatus as set forth in claim 1, including a drive device operatively associated with the slide door to move the slide door between the fully closed position and the fully open position.

5. The vehicular slide door apparatus as set forth in claim 4, including a clutch mechanism for alternatively establishing and interrupting a coupling between the slide door and the drive device.

6. The vehicular slide door apparatus as set forth in claim 1, including a spring which urges the armature toward the friction plate.

7. A vehicular slide door apparatus comprising:

a slide door movable along a lengthwise direction of a vehicle body for opening and closing an opening area formed in a lateral side of the vehicle body; and a brake device provided at the lateral side of the vehicle body for applying a brake force to the slide door by way of an elongated member which moves together with the slide door, the brake device including a shaft, an armature mounted on the shaft to move along the shaft and rotate together with the shaft, an electromagnetic coil winding device opposing the armature, and a friction plate secured to the electromagnetic coil winding device and engageable with the armature.

8. The vehicular slide door apparatus as set forth in claim 7, including an electrically operated drive device operatively associated with the elongated member, and a clutch mechanism for alternatively establishing and interrupting a coupling between the slide door and the electrically operated drive device.

9. The vehicular slide door apparatus as set forth in claim 8, wherein the brake device is mounted on the electrically operated drive device.

10. The vehicular slide door apparatus as set forth in claim 7, including a spring which urges the armature toward the friction plate.

* * * * *

UNITED STATES PATENT AND TRADEMARK OFFICE

CERTIFICATE OF CORRECTION

PATENT NO. : 6,270,149 B1
DATED : August 7, 2001
INVENTOR(S) : Ryoichi Fukumoto et al.

It is certified that error appears in the above-identified patent and that said Letters Patent is hereby corrected as shown below:

Title page,
Item [73], is corrected as follows:

-- [73] Assignee: Aisin Seiki Kabushiki Kaisha
Kariya, Aichi-Ken (JP) --

Signed and Sealed this

Fourteenth Day of January, 2003

JAMES E. ROGAN
*Director of the United States Patent and Trademark Office*